US006160193A

United States Patent [19]

Gore

[11] Patent Number: 6,160,193

[45] **Date of Patent: *Dec. 12, 2000**

[54] METHOD OF DESULFURIZATION OF HYDROCARBONS

[76] Inventor: Walter Gore, 201 Artic Slope Ave. Suite 200, Anchorage, Ak. 99518

[ * ] Notice: This patent issued on a continued prosecution application filed under 37 CFR 1.53(d), and is subject to the twenty year patent term provisions of 35 U.S.C. 154(a)(2).

[21] Appl. No.: 09/199,709

[22] Filed: Nov. 23, 1998

Related U.S. Application Data

[60] Provisional application No. 60/066,656, Nov. 20, 1997.

[51] Int. Cl.[7] ..... C10G 17/00; C10G 45/00; C10G 17/02; C10G 29/22

[52] U.S. Cl. ..... 585/833; 208/208 R; 208/219; 208/240; 208/254 R

[58] Field of Search ..... 208/208 R, 219, 208/240, 254 R; 585/833

[56] References Cited

U.S. PATENT DOCUMENTS

| | | |
|---|---|---|
| 4,493,765 | 1/1985 | Long et al. . |
| 4,954,229 | 9/1990 | Kim et al. . |
| 5,228,978 | 7/1993 | Taylor et al. . |
| 5,458,752 | 10/1995 | Lizama et al. . |

FOREIGN PATENT DOCUMENTS 0565 324 A1 10/1993 European Pat. Off. .

OTHER PUBLICATIONS

Zannikes et al "Desulfurization of petroleum fractions by oxidation and solvent extraction" Fuel Processing technology 42, 1995 pp. 35–45.

*Primary Examiner*—Walter D. Griffin
*Assistant Examiner*—Tam M. Nguyen
*Attorney, Agent, or Firm*—Michael Tavella; George Renzoni

[57] ABSTRACT

A method for the removal of sulfur and nitrogen containing compounds from petroleum distillates. Sulfur- and nitrogen-containing compounds are oxidized using a selective oxidant to create compounds that can be preferentially extracted from a petroleum distillate due to their increased relative polarity. Oxidation is accomplished by contacting an oxidant with a distillate under optimum conditions for that distillate and continuing the reaction until oxidized sulfur- and nitrogen-containing compounds are confirmed. Extraction is accomplished by contacting oxidized distillate with a non-miscible solvent that is selective for the relatively polar oxidized sulfur- and nitrogen-containing compounds. The oxidized compounds and solvent are separated from the distillate by gravity separation or centrifugation. The distillate is water washed and polished using clay filtration. The extraction solvent is separated from the solvent/oxidized compound mixture by a simple distillation for recycling. The high sulfur/high nitrogen fraction can be recovered using any number of treatments.

22 Claims, 6 Drawing Sheets

High Pressure Nozzle

P Pump

M Mixer

P Pump

FIG. 4

| PROPERTY | LIMITS | HYDROGEN PEROXIDE/ACETIC ACID DMSO SOLVENT | | CARO'S ACID DMSO SOLVENT | |
|---|---|---|---|---|---|
| | | UNTREATED DIESEL | TREATED DIESEL | UNTREATED DIESEL | TREATED DIESEL |
| Total Sulfur, wt% | 0.5 max | 0.42 | 0.0036 | 0.4289 | 0.0164 |
| Gravity, API 60 °F | 30–37 | 32.9 | 34.5 | 32.9 | 34.7 |
| Flash Point, °F | 140° min | 152 | 138 | 152 | 123 |
| Cloud Point, °F | | | | | |
| Winter | +5° | | | | |
| Summer | +15° | +10°–+12° | +8° | +8° | +8° |
| Pour Point, °F | | | | | |
| Winter | +0° | | | | |
| Summer | +10° max | +5° | +5° | +5° | +10 |
| Distillation, °F | | | | | |
| IBP | | 355 | 352 | 342 | 336 |
| 10% recov | | 428 | 426 | 422 | 416 |
| 20% recov | | 498 | 490 | 494 | 484 |
| 50% recov | | 566 | 570 | 564 | 564 |
| 90% recov | 540°–640° | 626 | 620 | 629 | 624 |
| FBP | | 664 | 652 | 664 | 660 |
| Vol % recov | | 99 | 99.5 | 99 | 99 |
| Residue, % | | 0.5 | 0.25 | 0.5 | 0.5 |
| Loss, % | | 0.5 | 0.25 | 0.5 | 0.15 |
| Viscosity, KIN 40° cst | 2–4.3 | 3.8 | 3.65 | 3.77 | 3.71 |
| Ash, wt% | 0.01 max | 0.002 | 0.004 | 0.003 | 0.001 |
| Carbon Residue on 10% bottoms, wt% | 0.35 max | 0.08 | 0.16 | 0.14 | 0.04 |
| BTU per gallon (gross) | 136,000min | 139,700 | 138,318 | 139,664 | 138,155 |
| Calculated Cetane index | 45 min | 48 | 55 | 48 | 51 |
| Copper Strip Corrosion | 3 max | 1 | 1 | 1 | 1 |
| Existent Gum | | 13.8 | 88 | 136.2 oily | 173 oily |
| Smoke Point | | | 14.6 | 14.9 | 15.9 |
| Compositional Analysis | | | | | |
| Aromatics | | 30.5 | 24.1 | 21.4 | 11.0 |
| Olefins | | 3.2 | 6.9 | 7.14 | 2.0 |
| Saturates | | 66.2 | 68.9 | 71.43 | 87.5 |

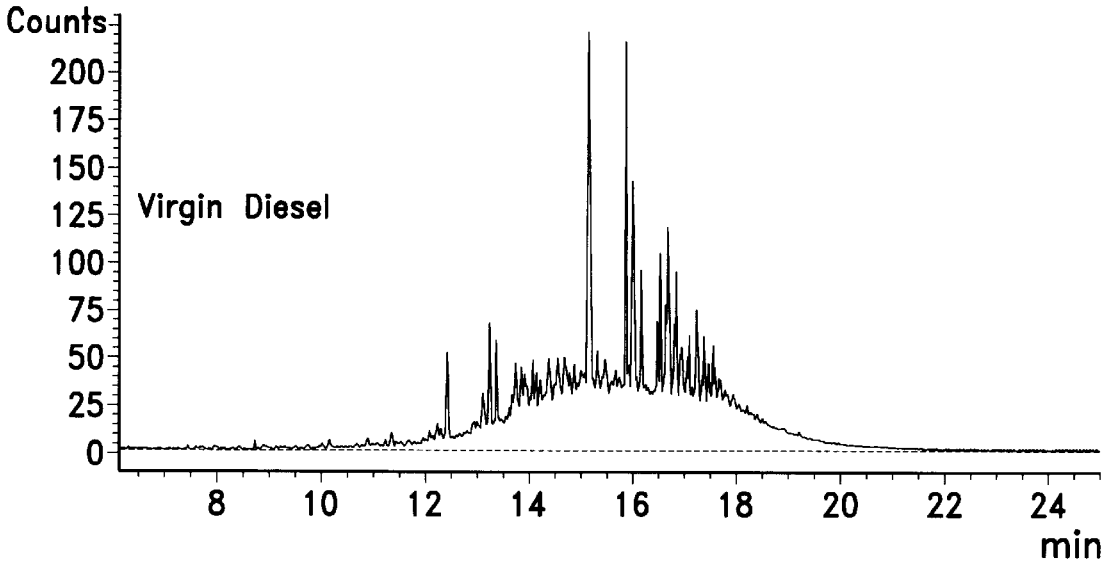
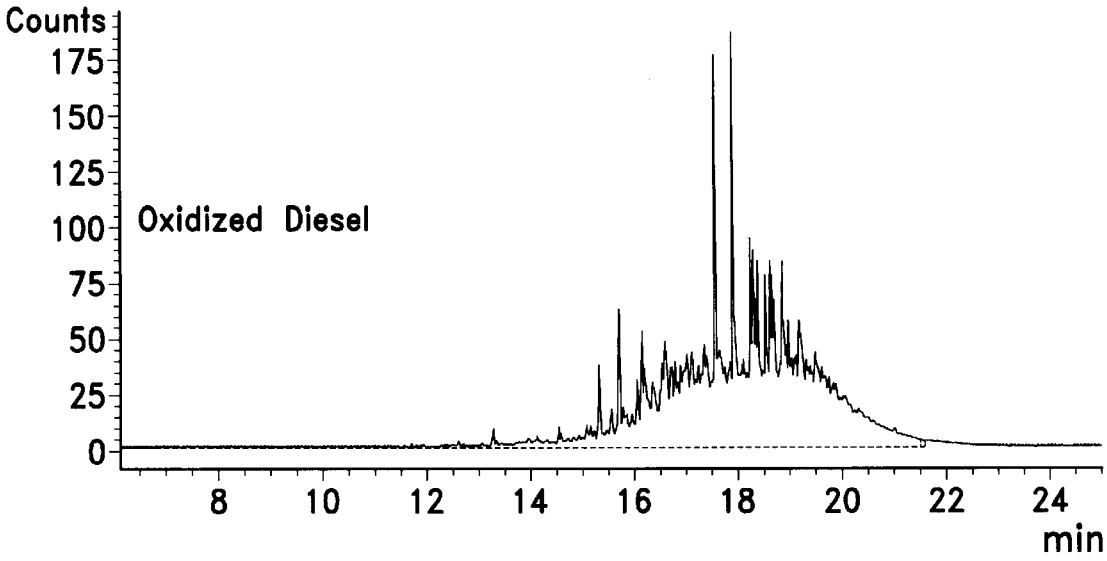
FIG. 5

METHOD OF DESULFURIZATION OF HYDROCARBONS

This application claims the benefit of U.S. Provisional Application No. 60/066,656, filed Nov. 20, 1997.

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to a method of desulfurization of hydrocarbons and particularly to a method of desulfurization of hydrocarbons that uses an efficient, selective oxidation and removal of sulfur- and nitrogen-containing compounds from petroleum distillates wherein the physical properties of the fuel either remain constant or improved.

2. Description of Related Art

Environmental concerns have driven the need to remove many impurities from hydrocarbon based distillate fuels. Sulfur- and nitrogen-containing compounds are of particular interest because of their tendencies to produce precursors to acid rain and airborne particulate material. Several processes have been proposed in the past to deal with the problem of removing of these compounds from fuels. The most prevalent and common industrial process is that of treating the fuel under high temperatures and high pressures with hydrogen. This process is called hydrotreating and has received extensive attention since its original invention in Germany before the Second World War. Literature describing this technology is immense, amounting to thousands of patents and scientific and engineering publications.

Briefly stated, hydrotreating is a process in which a petroleum fraction is heated, mixed with hydrogen, and fed to a reactor packed with a particulate catalyst. Temperatures in the reactor typically range from 600 to 700 F. (315 to 370 C.). At these temperatures, some or all of the feed may vaporize, depending on the boiling range of the feed and the pressure in the unit. For heavier feeds it is common for the majority of the feed to be liquid. Reaction pressures range from as low as 500 psig (pounds per square inch, gauge) to as high as 2500 psig depending on the difficulty of removing the sulfur. In the manufacture of distillate fuels such as diesel or jet fuel, pressures higher than 800 psig are common. The feed and hydrogen mixture typically flows downward through the reactor, passing around and through the particulate catalyst. Upon leaving the reactor, the mixture of treated fuel and hydrogen flows through a series of mechanical devices to separate and recycle the hydrogen, remove poisonous hydrogen sulfide generated in the reaction, and recover the desulfurized product. Hydrotreating catalysts slowly lose activity with use, and must be removed and replaced every two to three years.

As used in large integrated refineries, hydrotreating is very effective and relatively inexpensive. However, in small refineries, and especially those with limited capabilities, it can be prohibitively expensive because of the effects of scale-up economics. When process equipment is built, it typically costs much less than twice as much to build a unit with twice the capacity; engineers typically estimate that doubling the size increases the cost by only about 50%. The converse of the scale-up effect occurs when processes are scaled down; smaller process units are only slightly less expensive to build than larger one. Thus the investment for a small 5,000 barrel per day (bpd) hydrotreater is not 1/10 that of a 50,000 bpd hydrotreater, but is about 1/4 the cost of the much larger unit.

Because of the way processes are operated and controlled, the manpower costs for the smaller unit are roughly the same as those of the larger one.

Another cost problem faced by small refiners is the lack of an inexpensive hydrogen source. Hydrotreating typically consumes 200 to 500 scfb (standard cubic feet per barrel) of hydrogen, and may consume as much as 1000 scfb. Manufacture of hydrogen from natural gas typically costs about $3 per 1000 scf, adding about $0.60 to as much as $3.00 to the cost of treating a barrel of feed for a small refinery. In large refineries, hydrogen is often available as a byproduct of the gasoline manufacturing process known as platinum reforming. As such it is virtually free. In small refineries with no platinum reformer, a dedicated hydrogen manufacturing plant must be installed, adding to the refinery operator's investment burden and operating costs.

These economics favor those who wish to operate at large scale, but they make hydrotreaters prohibitively expensive for smaller refineries. As a result, tightening environmental regulations have had the effect of forcing small refineries to close. Some small refineries have survived by changing product mix to emphasize low value products such as asphalt, selling liquid products to large refineries to use as intermediates.

In order to continue to operate successfully, refineries and others have explored alternatives to hydrotreating. One idea that has been explored involves oxidizing the sulfur and nitrogen compounds in a distillate then removing them by selective extraction. This approach has met with only limited success primarily because of problems of non-selectivity of oxidants or the extraction solvents.

It is known that contacting a distillate with an oxidant, can convert sulfur- and nitrogen-containing compounds to much more polar oxidized species. Such oxidants include peroxy organic acids, catalyzed hydroperoxides, inorganic peroxy acids or peroxy salts. Experience shows that such oxidants are typically those where the predominant oxidation does not include a free radical chain reaction oxidation of the sulfur or nitrogen, but appear to operate by donating oxygen atoms to the sulfur in thiols and thiophenes to form sulfoxides or sulfones, or to the nitrogen in amines, pyridines or pyroles to form nitro, nitroso, or ammine oxide compounds. It is also known that all of these oxidized sulfur- or nitrogen-containing compounds are orders of magnitude more soluble in non-miscible solvents than their unoxidized counterparts.

The next step of this process is removal of the oxidized compounds by contacting the distillate with a selective extraction solvent. This solvent should be sufficiently polar to be selective for polar compounds is the next step of this process. Examples, of polar solvents include those with high values of the Hildebrand solubility parameter $\delta$; liquids with a $\delta$ higher than about 22 have been successfully used to extract these compounds. Examples of polar liquids, with their Hildebrand values, are shown in the following table:

| | |
|---|---|
| Acetone | 19.7 |
| Butyl Cellosolve | 20.2 |
| Carbon disulfide | 20.5 |
| Pyridine | 21.7 |
| Cellosolve | 21.9 |
| DMF | 24.7 |
| n-Propanol | 24.9 |
| Ethanol | 26.2 |
| DMSO | 26.4 |
| n-Butyl alcohol | 28.7 |
| Methanol | 29.7 |
| Propylene glycol | 30.7 |
| Ethylene glycol | 34.9 |
| Glycerol | 36.2 |
| Water | 48.0 |

However, as will be obvious to those skilled in the art, mere polarity considerations are insufficient to define successful extraction solvents. Methanol, for instance, has sufficient polarity, but its density, 0.79 g/cc, is about the same as that of typical hydrocarbon fuels, making separations very difficult. Other properties to consider include boiling point, freezing point, and surface tension. Surprisingly, the combination of properties exhibited by DMSO make it an excellent solvent for extracting oxidized sulfur and nitrogen compounds from liquid fuels.

In U.S. Pat. No. 3,847,800, Guth and Diaz proposed a process for treating diesel fuel that used oxides of nitrogen as the oxidant. However, nitrogen oxides have several disadvantages that can be traced to the mechanism by which they oxidize distillates. In the presence of oxygen, nitrogen oxides initiate a very non-selective form of oxidation termed auto-oxidation. Several side reactions also take place including the creation of nitro-aromatic compounds, oxides of alkanes and arylalkanes, and auto-oxidation products. Oxides of nitrogen are used to synthesize sulfoxides because they tend to inhibit the formation of sulfones due to the presence of oxonium salts. However, for the purposes of sulfur removal from fuels, sulfones are the desired product of sulfur oxidation because of their increased dipole moment, hence, higher solubility in the non-miscible solvent. Thus, nitrogen oxide based oxidants do not yield the appropriately oxidized sulfur compounds in distillate hydrocarbons without creating many undesirable byproducts.

The Guth and Diaz patent also proposes the use of methanol, ethanol, a combination of the two, and mixtures of these and water as an extraction solvent for polar molecules. Although these have proved to be acceptable extraction solvents for this system, they do not perform as well as others.

U.S. Pat. No. 4,746,420, issued to Darian and Sayed-Hamid also proposes the use of a nitrogen oxides to oxidize sulfur- and nitrogen-containing compounds followed by extraction using two solvents—a primary solvent followed by a cosolvent that is different from the primary. The sulfur and nitrogen results published in this patent are consistent with those expected from incomplete oxidation of these compounds followed by extraction.

In European Patent Application number 93302642.9, Method for Recovering Organic Sulfur Compounds from a Liquid Oil, Tetsuo claims many oxidants as being essentially equal in their ability to oxidize sulfur- and nitrogen-containing compounds. However, I have discovered that many of these oxidants are not selective and others are ineffective. Oxidizers that proceed by an auto oxidation mechanism involving a free radical tend not to be selective for the sulfur- and nitrogen-containing compounds of interest, producing numerous side reactions and, hence, various undesirable byproducts.

Tetsuo teaches the use of distillation, solvent extraction, low temperature separation, adsorbent treatment and separation by washing to separate and oxidized organic sulfur compound from the liquid oil through the utilization of differences in the boiling point, melting point and/or solubility between the organic sulfur compound and the oxidized organic sulfur compound. While most of these work with some success, they do not provide the level of sulfur removal that my method achieves.

In "Desulfurization of Petroleum Fractions by Oxidation and Solvent Extraction", Fuel Processing Technology, 42, 1995, 35–45, by F. Zannikos, E. Lois, and S. Stournas, the authors describe an oxidation and solvent extraction technique for the removal of sulfur containing compounds. Peroxyacetic acid was used in an inefficient manner to oxidize the sulfur compounds in a diesel fuel. Methanol, dimethyl formamide, and N-methyl pyrrolidone were used as simple one-stage extraction solvents at different ratios. However, the results of their work show these solvents removed much of the usable oil along with the oxidized sulfur compounds. In order to get sulfur levels of approximately 500 PPM with these solvents they report a loss of 30 or more percent of the overall fuel. Such a loss is completely unacceptable on a commercial basis. No mention of a process is made within this publication. Instead, the authors describe laboratory studies of the oxidation and extraction of sulfur compounds using methods like those taught in the art described above.

Two major problems are seen throughout this art. First, the oxidants chosen do not always perform optimally. Many oxidants engage in unwanted side reactions that reduce the quantity and quality of the treated fuels. The second problem is the selection of a suitable solvent for the extraction of the sulfur or nitrogen compounds. Using the wrong solvent may result in removing desirable compounds from the fuel or extracting less than a desired amount of the sulfur and nitrogen compounds from the fuel. In either case, the results can be costly.

BRIEF SUMMARY OF THE INVENTION

The present invention overcomes the difficulties described above.

Sulfur- and nitrogen-containing compounds are oxidized using a selective oxidant to create compounds that can be preferentially extracted from a petroleum distillate due to their increased relative polarity. Oxidation is accomplished by contacting an oxidant with a distillate under optimum conditions for that distillate and continuing the reaction until oxidized sulfur- and nitrogen-containing compounds are confirmed. Oxidation is then stopped before the oxidant attacks other, less reactive, hydrocarbons. Distillate containing oxidized sulfur- and nitrogen-containing compounds is separated from the depleted oxidant. The oxidant can then be regenerated for re-use. Any unused oxidant that remains in the treated fuel can be removed by washing and chemical post-treatment. The oxidized compounds can be extracted from the distillate by contacting oxidized distillate with a non-miscible solvent. This solvent is selective for the relatively polar oxidized sulfur- and nitrogen-containing compounds. The oxidized compounds and solvent are separated from the distillate by gravity separation or centrifugation. The distillate is water washed to recover any traces of dissolved extraction solvent and polished using clay filtration. The extraction solvent is separated from the mixture of solvent and oxidized compounds by a simple distillation for recycling. By following these steps, the highest amount of undesirable compounds is extracted from the fuel while doing the least amount of damage to the end product. In many cases the process improves the fuel quality as well.

The high sulfur/high nitrogen fraction can be recovered using any number of treatments including bioprocessing, thermal decomposition, hydrolysis, or electroprocessing to remove the sulfur or nitrogen and return the remaining hydrocarbon to the fuel stream. Some of the compounds created by this process may also have properties that make them valuable for other uses, and they may be selectively removed for further chemical processing or sale.

Oxidant studies were performed to discover the types of oxidants that proved selective for the sulfur and nitrogen compounds of interest; oxidation mechanisms were used as a determining factor. Gas chromatography was used to demonstrate the oxidation of sulfur-containing compounds; nitrogen compounds were present at levels that were too low to observe by GC; they were included as a result of other measurements. Solvent studies were guided by polarity and other properties. Reversed phase thin layer chromatography (TLC) was found to be useful in screening useful solvent systems for efficient, selective extraction.

BRIEF DESCRIPTION OF THE DRAWINGS

FIG. 4 is a table showing ASTM data of untreated fuel and fuel treated using this process.

FIG. 5 is a chart showing the levels of non oxidized sulfur-compounds versus oxidized sulfur-compounds in Light Atmospheric Gas Oil (LAGO).

DETAILED DESCRIPTION OF THE INVENTION

Figure 1:
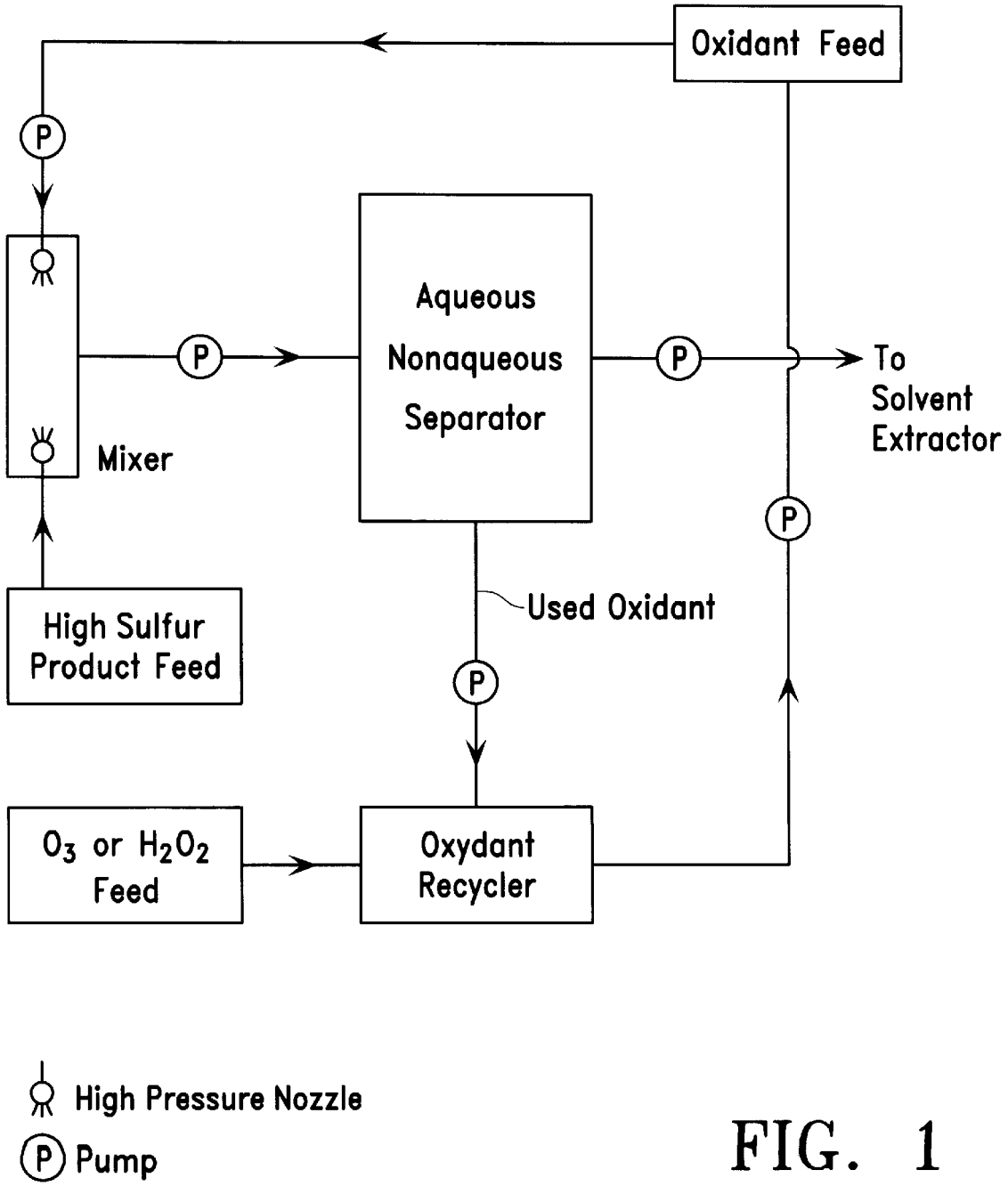
FIG. 1 is a schematic diagram of a liquid oxidation process.

This invention involves a two-step process for removing sulfur from fuel oil and other hydrocarbons. This process, which may be continuous or in batch mode, does not use high temperatures or pressures, as these terms are understood in the oil refining industry. The first step of the process is to oxidize the sulfur-containing compounds of the fuel. The oxidization process converts sulfur compounds to highly polar sulfones. Nitrogen compounds are likewise converted to polar oxidized species. An example of an oxidizing agent that can be successfully used in this process is peroxysulfuric acid, often called Caro's acid. This oxidant is typically used in amounts calculated to convert all of the sulfur to sulfones and all of the nitrogen to nitro compounds. Larger amounts may be used to ensure complete conversions in reasonable times, although large excesses are not necessary and add undesirable costs to the process. Using standard laboratory analyses of Sulfur and nitrogen levels in the fuels, works skilled in the art can calculate oxidant requirements for sulfur oxidation using the known stoichiometry for the oxidation reaction to yield sulfones, using two moles of oxygen per mole of sulfur to be oxidized. Oxygen requirements for nitrogen oxidations, where a variety of products are possible, can be estimated by assuming that all nitrogen species are converted to nitro (—$NO_2$) and require two moles of oxygen per mole of nitrogen to be treated. Those skilled in the art will recognize that nitrogen levels are generally a factor of 10 to 100 smaller than sulfur levels, and will readily recognize that adding a small (about 10%) excess of oxidant beyond that needed for the sulfur satisfies needs for nitrogen oxidation. An example of the method used to determine the amount of oxidation required follows. The oxidant required is calculated on a per liter basis. that is, the oxidant required to treat one liter of fuel. One liter of fuel is converted to kilograms of fuel. Then, the measured weight percent of sulfur is used to get a quantity of sulfur, first in Kilograms, which is converted to grams, and finally to moles. A minimum of two moles of oxidant are needed to create a mole of sulfone. An excessive amount of oxidant is used to ensure as much of the sulfur is oxidized as possible. This excess amount of oxidant also takes into account side reactions and inefficiencies in the reaction. Approximately 50 percent excess oxidant has been used to ensure proper results. However, less than a 50 percent excess may also be used. It is possible that only a 5 percent excess oxidant amount can work. Finally, the molar value of oxidant is then converted to grams of oxidant and the process can then go forward. A numerical example follows: for one liter of fuel, having a measured sulfur weight percent of 0.0042 kilograms of sulfur per kilogram of fuel, the following equation can be used: (1 L fuel)*(0.885 Kg fuel/L fuel)*(0.0042 Kg S/Kg Fuel)*(1000 g S/Kg S)*(1 mole S/32 g S)*(3 moles Oxidant)/1 mole S)*(76 g Oxidant/mole of Oxidant)=the amount of oxidant in grams, needed to oxidize the fuel. Of course, for different oxidants, and weight percent of sulfur, the numbers change, but the process is the same. As noted above, this equation also uses a figure of 50 percent excess oxidant. If less oxidant is used, the amount of oxidant changes.

It will also be apparent to those skilled in the art that a variety of chromatographic and spectroscopic methods can be used to differentiate between sulfones and those sulfur compounds found in native petroleum samples. An excellent example is the combination of gas chromatographic and atomic emission spectroscopy. These techniques can be applied in measuring the degree of completion of the oxidations carried out in this invention.

Oxidations are typically carried out at about 30 to 100° C., and preferably at 60 to 95° C. Low pressures are used, typically less than about 150 psig (pounds per square inch, gauge), and preferably less than about 30 psig, the autogenous pressures created by the vapors of the fuel and the various reactants and solvents. Oxidations using gaseous reagents such as ozone or oxygen requires pressures at the upper end of the range to enhance solubility of the gases.

The second step of the process uses a solvent to extract the sulfones from the fuel oil. The process produces two end products: a stream of fuel product that has a very low sulfur content (less than 0.05 percent); and a high-sulfur stream that must be treated for disposal or that can be further processed or sold for other uses. Solvents used for the extraction are typically polar organic materials with low solubility in the fuel and high affinity for the sulfones and other polar oxidized species. They should have low affinity for the more polar aromatic compounds typically found in the fuels. Other important properties include high density to facilitate gravity separation. Extraction can be carried out at any combination of temperature and pressure where both the solvent and the treated hydrocarbon mixture are liquids. Extraction is preferably carried out at temperatures below about 100° C. and at low pressures, below 15 psig, to simplify the process.

In accordance with the invention, many reagents can achieve the selective conversion of sulfur compounds to a sufficient extent to allow production of a low-sulfur product with insignificant, if any, alteration of the original chemical structure of the fuel. The most attractive sulfur compound oxidizing reagents from the standpoint of selectivity, safety and regenerability are perboric acid, ozone, Caro's acid, sodium perborate, and peroxyacetic acid. These may be used individually, or in combination.

Fuels in the diesel distillation range and lighter work well in the process and could be treated using the same reactor system.

Several process schemes, as discussed below, are possible. However, from an economical basis, the first stage of the process, i.e., for oxidizing the sulfur compounds in the raw, and treatment of the high-sulfur stream, are of great importance as to the overall process economics.

An Overview of the Process

In the instant process, oxygen (available from a peroxide or other oxygen donor compound) is used to convert the sulfides to the much more polar sulfoxides or sulfones (these molecules have one or two oxygen atoms attached to the sulfur atom). Once converted, the polar sulfoxides or sulfones can be removed by solvent extraction using a solvent or adsorbent that is immiscible, or only slightly miscible with the hydrocarbon fuel, to selectively interact with the polar sulfoxides or sulfones to form a separate liquid layer that can be removed from the hydrocarbon layer. This extraction process is a low temperature and low energy process as compared to prior art catalytic, high temperature, hydrodesulfurization methods.

As noted, the invention produces a very low-sulfur fuel stream and a high-sulfur extract. There are several options for treating this high-sulfur stream: 1) biocatalytic treatment of the high sulfur extract to yield additional hydrocarbon product and sulfates; 2) combustion of the stream to generate energy, with removal of the sulfur as gypsum, ammonium sulfate or similar product; 3) use the stream as an asphalt or asphalt modifier; and 4) electrochemical decomposition.

There are several process designs envisioned for the oxidization step: These can be grouped into categories that use similar specific chemistry, but have differences with respect to the raw materials needed to operate. These categories include:

Category (1) Hydrogen-peroxide based processes
- a) perboric acid oxidation
- b) Caro's acid oxidation (persulfuric acid)
- c) peracetic acid oxidation Category (2) Ozone-based processes
- a) direct ozone oxidation
- b) dioxirane oxidation Category (3) Air or Oxygen-based processes
- a) catalyzed oxidations Once the fuel has been oxidized, the resulting sulfones must be extracted from the fuel. Several different solvents have been found to selectively extract these compounds from the fuel. These include Dimethyl Sulfoxide (DMSO), methanol, sulfolane, triethanolamine, and acetonitrile.

Oxidation Reactions

As discussed above, several agents can be used for the oxidation step of the invention. Peroxy acids are one such agent and can be prepared by oxidizing an acid (HA) with 20–95 percent aqueous hydrogen peroxide in the following manner:

$$HA_{(aq)}+H_2O_{2(aq)}\rightarrow HAO_{(aq)}+H_2O$$

This aqueous solution is mixed with a no. 2 marine diesel fuel at 70 to 90° C. and allowed to thoroughly stir for approximately 1 hour. The following reaction is the type of which occurs:

$$R_2S+2HAO\rightarrow R_2SO_2+HA$$

In this reaction, $R_2S$ is an organosulfur compound; examples include various alkylthiols, dialkylsulfides, thiophenes, benzothiophenes, dibenzothiphenes and any of their many substituted homologues. $R_2SO_2$ represents the corresponding sulfone compounds. In the same way, organonitrogen compounds such as the various alkylamines, pyridines and so on are oxidized to the corresponding nitro, nitroso, N-oxide compounds.

The resulting sulfone compounds are much more polar than the parent sulfides, making them more amenable to extraction using non-miscible polar solvents. Selectivity of the oxidation to centers of high electron density, like sulfur, has been greatly improved over that reported in the prior art. In the prior art, examples of oil oxidation selectivity show that product oils are recovered in low yields, or have product properties that are not optimal. Using the process disclosed herein produces fuel product that have improved product specification—both in reduced sulfur and an improved cetane index. Moreover, the tendency to form gum is essentially unchanged and acid numbers are reduced. Compositional analysis of the fuel indicates that the oxidation does not materially change the fuel structural types present. Tests also indicate no significant levels of undesirable oxidation products either. A summary of a comparison of fuel characteristics is provided in FIG. 4.

At this point, the sample is tested using gas chromatography (for laboratory settings) or an infrared spectrometer (in a commercial process) to determine the sulfone concentration. In the case of the infrared spectrometer the device is tuned to measure the sulfone concentration using the sulfur- or nitrogen-oxygen bond absorption energies.

Oxidation conditions are chosen to prevent or minimize undesired side reactions. These include reactions where hydrocarbon molecules are oxidized to acids, aldehydes, alcohols, ethers, and other oxygen-containing species. Such reactions are wasteful of oxidant and create compounds that are detrimental to fuels.

Side reactions are minimized by proper choice of oxidizing agent and by running the reaction at the lowest possible temperatures. These temperatures are between about 40° C. and about 110° C., and preferably between about 50° C. and about 95° C.

The extent of the reaction can be measured using a variety of chromatographic and spectroscopic techniques commonly available in refinery and research laboratories. Using the GC/MS technique, a well-known combination of gas chromatography and mass spectrometry, it is possible to measure the concentrations of various thiophenes and benzothiophenes in oxidized oil samples. Disappearance of these compounds from the samples indicates that they have been converted to the corresponding oxidized products. Measurements of peak sizes in treated samples, and comparison with peak sizes in the untreated feed oil, provides a quantitative estimate of the extent of reaction. FIG. 5 is a chart showing the levels of non oxidized sulfur-compounds versus oxidized sulfur-compounds in Light Atmospheric Gas Oil (LAGO) as a result of using the process. As FIG. 5 shows, the peak sizes shown for sulfur on the untreated sample is greatly reduced after the oxidation process.

Once the oxidation has proceeded to the extent that greater than 90% of the sulfur compounds, preferably greater than 95%, and most preferably greater than 98% conversion of the sulfur compounds to the corresponding sulfones. The oxidation is slowed by cooling the system to slow the reactions. As is well known to those skilled in the art, temperature reductions of 20 to 30° C. slows the reactions by a factor of five or ten. This cooling can accomplished passing the reaction mixture through a conventional heat exchanger, but a more efficient method is to contact the reaction mixture directly with cold water. This step has the added advantage of providing a washing step to remove the majority of any unused oxidant.

The fuel, and aqueous wash material can be separated using a simple gravity separator, until the oil and water form two distinct liquid phases.

The quench water may also contain a reducing agent such as sodium thiosulfate, sodium bisulfite or similar compounds, preferably as dilute aqueous solutions containing 1–5 weight percent of the reductant. Washing the oil with a reducing agent may also be performed as a separate step, after the initial quench. When peroxide-containing oxidants are used, any low levels of unused oxidants remaining after water washing can be removed by heating the separated oil fraction to decompose the peroxides. Heating to temperatures above about 100° C. and preferably above about 125° C. for short periods, about one to two minutes decomposes the peroxide to oxygen and water, according to the reactions $$2H_2O_2 \rightarrow 2H_2O + O_2$$

in the case of hydrogen peroxide, and $$RO_2H \rightarrow RH + O_2$$

in the case of an organic hydroperoxide.

Metal catalysts, including iron and platinum, can be used to accelerate this decomposition. DMSO can also be used to stop the oxidation process, by oxidation to the corresponding dimethylsulfone:

$$(CH_3)_2SO + H_2O_2 \rightarrow (CH_3)_2SO_2 + H_2O.$$

The use of DMSO in this way can, however, lead to loss of extraction solvent, and it is preferred to use less costly methods.

A. Perboric Acid Oxidation

Tests indicate peroxyboric acid is uniquely selective in the oxidation of sulfur containing compounds. Essentially, no conversion of hydrocarbons occurred. The only detected oxidations took place with sulfur species.

Perboric acids can be prepared by oxidizing an aqueous solution of boric acid with 30–50 percent aqueous hydrogen in the following manner:

$$H_3BO_{3(aq)} + H_2O_{2(aq)} \rightarrow H_3BO_{4aq)} + H_2O$$

EXAMPLE 1

Nine grams of boric acid was mixed in 60 ml of warm deionized water until dissolved. Sixteen ml of 30 percent hydrogen peroxide were added along with a catalytic amount (1 ml) of sulfuric acid. The solution was added dropwise into a one Liter 3-neck round-bottom flask equipped with a stir bar and a condenser containing 400 ml of Light Atmospheric Gas Oil (LAGO) with an initial sulfur content of 0.4275 percent by weight. The mixture was heated to 80° C. and stirred for two hours. Little or no discoloration was noted. The mixture was allowed to cool and stand at room temperature over night.

The hydrocarbon layer was decanted from the aqueous for solvent extraction (discussed below). The resulting fuel (approximately 92 percent of the original volume) exhibited a 0.0010 percent sulfur by weight.

B. Persulfuric (Caro's) Acid Oxidation

Peroxysulfuric acid has been shown to oxidize sulfur containing compounds. In all observed cases, the treated fuel quality is comparable or superior to the distillate prior to treatment. Note that quality is defined by the fuel's characteristics. See FIG. 4 for a comparison of the properties of the treated fuel as compared to untreated fuel.

Caro's acid can be prepared by oxidizing an aqueous solution of sulfuric acid with 30–50 percent aqueous hydrogen peroxide in the following manner:

$$H_2SO_{4(aq)} + H_2O_{2(aq)} \rightarrow H_2SO_{5aq)} + H_2O$$

EXAMPLE 2

Fifty grams of concentrated sulfuric acid were mixed with 30 ml of 30 percent hydrogen peroxide and the product solution was added dropwise to 400 ml of Light Atmospheric Gas Oil (LAGO) with an initial sulfur content of 0.4222 percent by weight, contained in a one Liter 3-neck round-bottom flask equipped with a stir bar and a condenser. The mixture was heated to 100° C. and stirred for 1.5 hours. The mixture was then cooled and the oxidized sulfur species were extracted through a liquid/liquid extraction with DMSO as described below.

C. Peroxyacetic Acid Oxidation

Peroxyacetic acid has been shown to selectively oxidize sulfur containing compounds. In all observed cases, the treated fuel quality (see FIG. 4) is comparable or superior to the distillate before treatment.

Peoxyacetic acid can be prepared by oxidizing glacial acetic acid with 30–50 percent aqueous hydrogen peroxide in the following manner:

$$CH_3COOH + H_2O_{2(aq)} \rightarrow CH_3COOOH_{(aq)} + H_2O$$

EXAMPLE 3

Fifty-three grams of concentrated acetic acid were mixed with 100 ml of 30 percent hydrogen peroxide and a catalytic amount of sulfuric acid (~1 ml). This was then added dropwise to 3 liters of Light Atmospheric Gas Oil (LAGO) in a 4 Liter Erlenmeyer flask equipped with a stir bar and a condenser. The LAGO had an initial sulfur content of 0.4222 percent by weight. The mixture was heated to 80° C. for 1.0 hours. The mixture was then cooled and the oxidized sulfur species were extracted through a liquid/liquid extraction with DMSO as described below. The final sulfur concentration of the treated fuel was 0.0036 wt % with 96% recovery of the original fuel volume.

II. Gas Phase Oxidation

Gas phase oxidation may be a preferred technique of sulfur oxidation primarily because of lower cost, simplicity of operation and operation without water. Gases like ozone, nitrogen dioxide, or dimethyl dioxirane may be passed through fuel to react with sulfur-containing compounds to produce oxidized sulfur compounds while not requiring subsequent separation of oil and water phases.

Oxidized species can be extracted using the solvent extraction techniques described below since they still take the form of sulfones.

A. Dioxirane

Dioxirane/Ethylene oxide has emerged as a leading candidate for gas phase oxidation because of its selectivity. Initial experiments using dimethyl dioxirane have shown good results in both selectivity and efficiency. Two methods for the preparation of dioxiranes are currently reported: 1) oxidation of acetone using OXONE (a trade name for potassium peroxymonosulfate), $$CH_3—CO—CH_3+KSO_4H \rightarrow CH_3—CO_2—CH_3+KSO_3H$$

and 2) oxidation of ethylene using ozone:

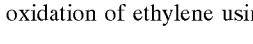

$$H_2C=CH_2+O_3=H_3C—CHO_2+O_2$$

EXAMPLE 4

Dioxirane and ethylene oxide were prepared by mixing ozone and ethylene gasses before diffusion into cool (40° C.) #2 diesel fuel. Reduction in the concentration of sulfur was from 0.4222 to 0.2346 wt % after 5 hr of very low concentration dioxirane/ethylene oxide.

B. Ozone

Direct oxidation using ozone has been successful in my tests. Cool temperatures, low pressures and low concentrations of ozone contribute to selective oxidation of sulfur containing organic compounds in a diesel range distillate.

EXAMPLE 5

A very low efficiency ozone generator capable of producing 100 mg/hr was connected by inert tubing to a glass diffusion device immersed in a flask containing 400 ml of LAGO (initial sulfur 0.4275 wt %). An ozone/air mixture was bubbled through the LAGO for 21.5 hours at 15–20° C. After extraction, the sulfur level in the treated LAGO was 0.1591 wt %.

III. Extraction of the Oxidized Species

Extraction may be accomplished using any number of polar organic solvents. The preferred solvent is Dimethyl Sulfoxide (DMSO). This is preferred because it is structurally similar to the compounds being extracted, thus having a similar polarity. It is relatively inexpensive. It is easily purified for re-use. It has very low solubility in hydrocarbon, and is much more dense (1.10 g/cc) than fuels (typically 0.8 to 0.9 g/cc), making it easy to separate from the fuel.

Extraction processes of this nature depend upon the solvent interaction with the target compound classes. Pressure and temperature affect the equilibrium and efficiency of the extraction; these changes are described by classical physical chemical formulations known as Raoult's law and Henry's laws. These laws teach is that variations in temperature and pressure tend to change the relative selectivities of different components in mixtures, although members of chemical classes (e.g., aromatics or paraffins) tend to behavior in similar ways.

DMSO, or another suitable solvent, is mixed with the oxidized fuel to accomplish two tasks: first, the quenching of the oxidant, if desired; second, the extraction of the oxidized materials. Solvent extraction produces two separate product streams: the first product is a very low sulfur fuel having up to 95% of the original mass of the hydrocarbon; and the second product is a high sulfur stream containing the oxidized thiophenes, benzothiophenes and dibenzothiophenes, as well as the DMSO and dimethyl sulfone.

The low sulfur stream may be polished by using adsorptive clay filtration, which then yields a fuel product that contains less than 0.05% sulfur by weight.

The high sulfur stream, containing DMSO and oxidized Thiophenes is then treated with approximately 25–45 by volume of process water. Water and DMSO are completely miscible, and increasing levels of water decrease the solubility of oily materials in the DMSO. Thus the treatment inverts the liquid, forcing the formation of an oil containing the oxidized thiophenes as a separate phase. This oil is then decanted away for further treatment, The DMSO/water stream is then ready for separation by distillation for subsequent reuse in the extraction stage.

Figure 6:
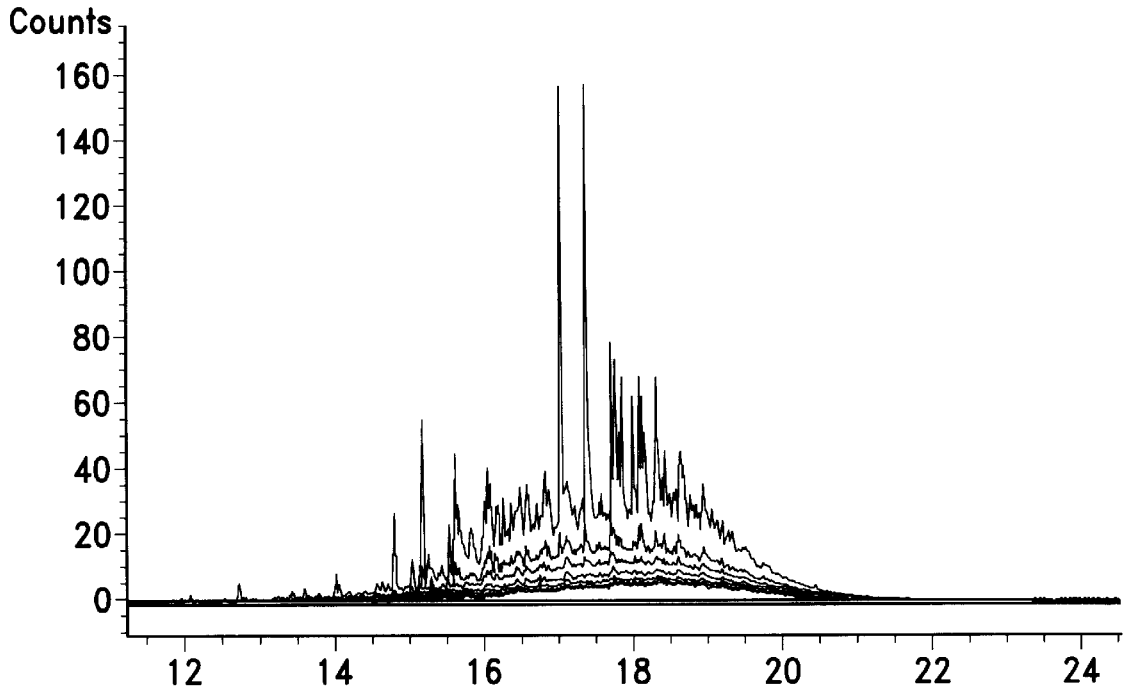
FIG. 6 is a chart showing the extraction efficiency of DMSO as a solvent for 7 sequential extractions. The Sulfur concentrations range from 3840 PPM to 510 PPM for the samples shown.

FIG. 6 is a chart showing the extraction efficiency of DMSO as a solvent for 7 sequential extractions. The Sulfur concentrations range from 3840 PPM to 510 PPM for the samples shown.

An example of the steps of the DMSO extraction stage follows:

EXAMPLE 6

1) 75 ml of treated LAGO containing oxidized thiophenes, benzothiophenes and dibenzothiophenes was placed in a separatory funnel and allowed to settle.

2) A tiny aqueous layer, probably containing a small amount of oxidizer, formed at the bottom of the separatory funnel. It was removed.

3) A 25 ml aliquot of DMSO was added to the LAGO and the mixture was shaken for 1–2 minutes.

4) The contents of the separatory funnel were allowed to settle for 5–10 minutes to form two distinct layers, a heavier DMSO layer on the bottom and the extracted oil layer on the top.

5) The DMSO layer was removed and saved in an Erlenmeyer flask.

6) Steps 3–5 were performed two additional times.

7) Still in the separatory funnel, the extracted low sulfur fuel layer was washed with two 15 ml aliquots of water to remove residual DMSO. The water was added to the DMSO wash container. When the ratio of DMSO to water was approximately 2:1 a reddish oil formed on the top of the aqueous layer.

8) The low sulfur fuel layer was warmed to evaporate any dissolved water, polished through a clay filter, and then analyzed.

9) The DMSO/water/high sulfur oil mixture was placed into a separatory funnel where the DMSO/water was separated from the high sulfur oil.

Treatment of the high sulfur stream can be performed using techniques common to the art, such as hydrodesulfurization, or similar techniques.

Additional Examples

EXAMPLE 7

3.0 Liters of Light Atmospheric Gas Oil (LAGO) having an initial Sulfur content of 0.4222 weight %, as measured by a Horiba X-ray fluorescence spectrometer calibrated for diesel fuel, was placed in a 4 L heavy walled Erlenmeyer flask equipped with a PTFE coated stir bar and a thermometer. The LAGO and apparatus were placed on a heating type stir plate and stirring was initiated. Separately, in a 250 ml Erlenmeyer flask, 53 g of Glacial Acetic Acid was mixed with 100 ml of 30% $H_2O_2$ and 5 ml of concentrated sulfuric acid ($H_2SO_4$), added as a catalyst. This mixture was added to the fuel with vigorous stirring by the stir bar. The mixture was heated to approximately 65° C. in approximately 15 minutes, with stirring. The mixture was held at 80° C. and allowed to react in the well-stirred flask for an additional 45 minutes.

Following the oxidation of the fuel, a warm, reddish, oil layer was separated by decanting from a dark bottom aqueous layer. The oil layer was divided into two roughly equal parts, each put into a 2 L separatory funnel. Each fuel sample was extracted using 3×100 ml aliquots of laboratory grade dimethylsulfoxide (DMSO). The LAGO samples were subsequently washed twice with de-ionized water to remove traces of DMSO that may be detrimental to sulfur analysis. Water and DMSO fractions combined, resulting in a thick oil layer that was separated from the DMSO/water mixture. This layer was found to have a volume of 76 ml and a sulfur content of 7.54 wt %. The remaining LAGO amounted to 2.886 L (or 96.2%) and had an average of 0.1857 wt % sulfur.

The stripped LAGO were combined and then passed through a column of approximately 400 ml (approximately 150 g) of refinery clay. The final sulfur content of the LAGO was measured to be 0.0036 wt %.

EXAMPLE 8

400 ml of Light Atmospheric Gas Oil (LAGO) having an initial Sulfur weight by percentage of 0.4275 percent, as measured by a Horiba X-ray fluorescence spectrometer calibrated for diesel fuel, was placed in a 1 liter, three neck, round bottom flask equipped with a stir bar, an additional funnel, and a condenser.

Stirring and mild heating was initiated. 50 g of concentrated sulfuric acid ($H_2SO_4$) was mixed with approximately 30 ml of 30% hydrogen peroxide ($H_2O_2$) in an Erlenmeyer flask and submerged in a dry ice/isopropanol bath to form Caro's acid ($H_2SO_5$).

The Caro's acid was added dropwise to the stirring LAGO at 20° C. using the addition funnel. As soon as the Caro's acid addition was complete, a small aliquot of treated oil was quickly removed from the mixture for analysis. This 50 ml sample was washed 3× with 15 ml aliquots of Dimethylsulfoxide (DMSO) followed by two water washes in a 500 ml separatory funnel. The resulting LAGO was mixed dried over anhydrous sodium sulfate ($Na_2SO_4$). The LAGO was then tested for sulfur and found to contain 0.1513 wt % S. The remaining dry LAGO was further stripped by passing it through a bed of silica gel, which resulted in a final sulfur percentage of 0.1050 wt % S.

The remaining mixture in the 1 liter round bottomed flask was heated to 100° C. for a total of 1.5 hours. It was then cooled and cleaned in the same manner as above. The resulting fuel contained 0.0580 wt % S after washing with DMSO, water, and drying over sodium sulfate. After silica gel treatment, it contained less than the detection limit (0.0001 wt % S).

EXAMPLE 9

A sample of 200 ml of Light Atmospheric Gas Oil (LAGO) having an initial sulfur weight by percentage of 0.4275 percent, as measured by a Horiba X-ray fluorescence spectrometer calibrated for diesel fuel, was placed in a 1 L, three neck, round bottom flask equipped with a stir bar, an additional funnel, and a condenser. Stirring was initiated. 6.9 grams of sodium perborate was mixed into a slurry with 50 ml of a 50% water/methanol solution. The perborate slurry was added to the vigorously stirred LAGO at 20° C. and was heated to 100° C. for a total of 2 hours. The mixture was then cooled under continued stirring overnight. The LAGO was stripped and cleaned using the procedure of example 2, above. The resulting fuel contained 0.0419 wt % S after washing with DMSO and then water, followed by drying over sodium sulfate. The LAGO contained 0.0010 wt % S after passing through silica gel.

IV. Large Scale Operations

The processes above can be scaled up from laboratory level to commercial operations. FIG. 1 shows a typical liquid non-miscible oxidant and extraction process. In this process, a high sulfur product feed may be in the form of one of the many types of petroleum distillates (e.g., marine diesel, #2 fuel oil, JP-8, JP-5 fuels, heavy naphtha, etc.) that, in raw form as distilled from crude oil may contain an unacceptable amount of sulfur-containing compounds. A liquid oxidant, selected from the list of oxidants described above in section I above, is introduced through a high pressure nozzle to the top portion of a temperature controlled reactor where it is mixed with the high sulfur product. The efficiency of this step is variable based on temperature, pressure and time spent in the mixing unit. A temperature of approximately 90° C. is most effective with the list of liquid, non-miscible oxidants described above. After mixing, the contents of the mixer flow into the central portion of the reaction separator where the two constituents of the mixture are allowed to separate.

Used oxidant is pumped from the bottom of the separator and pumped into an oxidant recycler where it is treated and oxidized back up to a reactive form and pumped back into the oxidant feed chamber.

Oxidized product is pumped to the extraction unit, described below. See FIG. 3.

Figure 2:
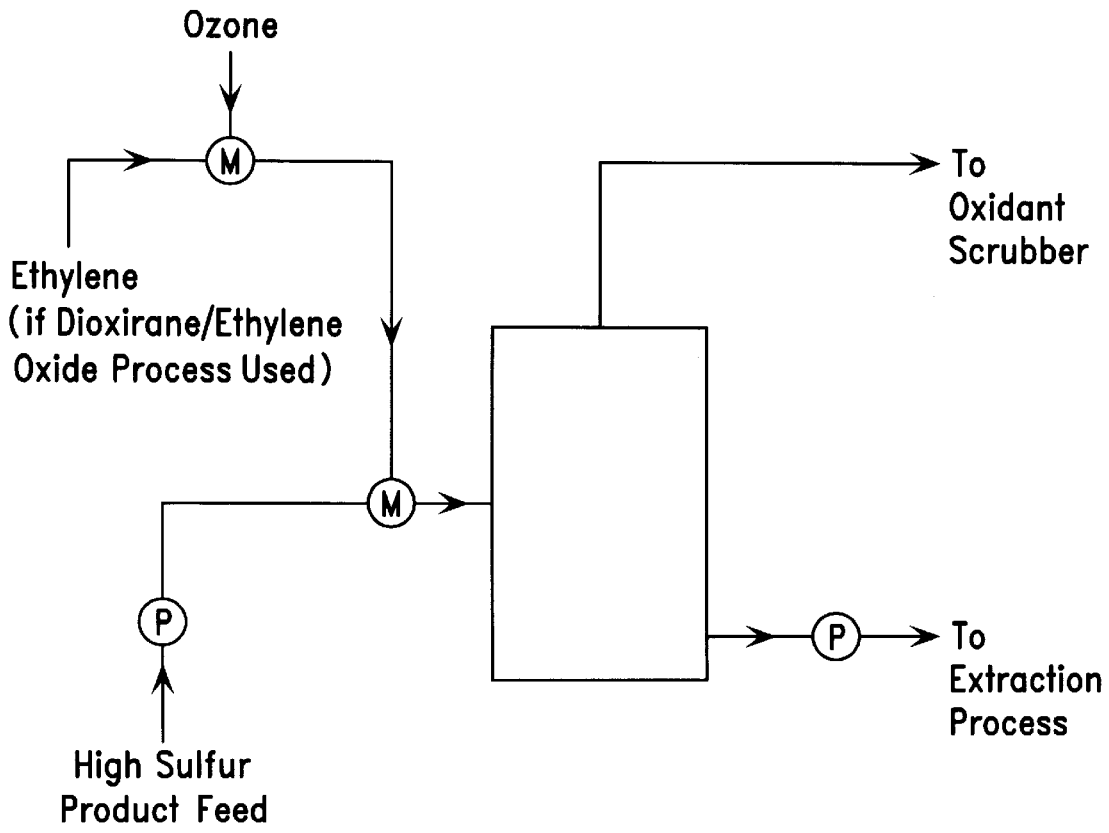
FIG. 2 is a schematic diagram of a gas oxidation process before extraction.

FIG. 2 shows the process for using a gas phase oxidant instead of a liquid phase oxidant. The gas phase oxidants have been discussed above. For a single oxidant (e.g., $N_2O_4$, $NO_2$, Ozone, etc.), the oxidant used is mixed directly with the high sulfur product feed under moderate pressure and temperature. Unused gaseous oxidant is removed from the top of the unit and quenched using means common to the art. Oxidized product is then pumped to the solvent extractor for quenching and treatment as described above, using the system of FIG. 3 below.

If a multiple oxidant system is used (using, e.g., dioxirane, ethylene oxide, etc.), the reactants must be mixed before the introduction of the petroleum stream. Here, an additional gas phase mixing manifold is required to create the appropriate oxidant in the gas phase before injection into the product mixer. See FIG. 2.

Figure 3:
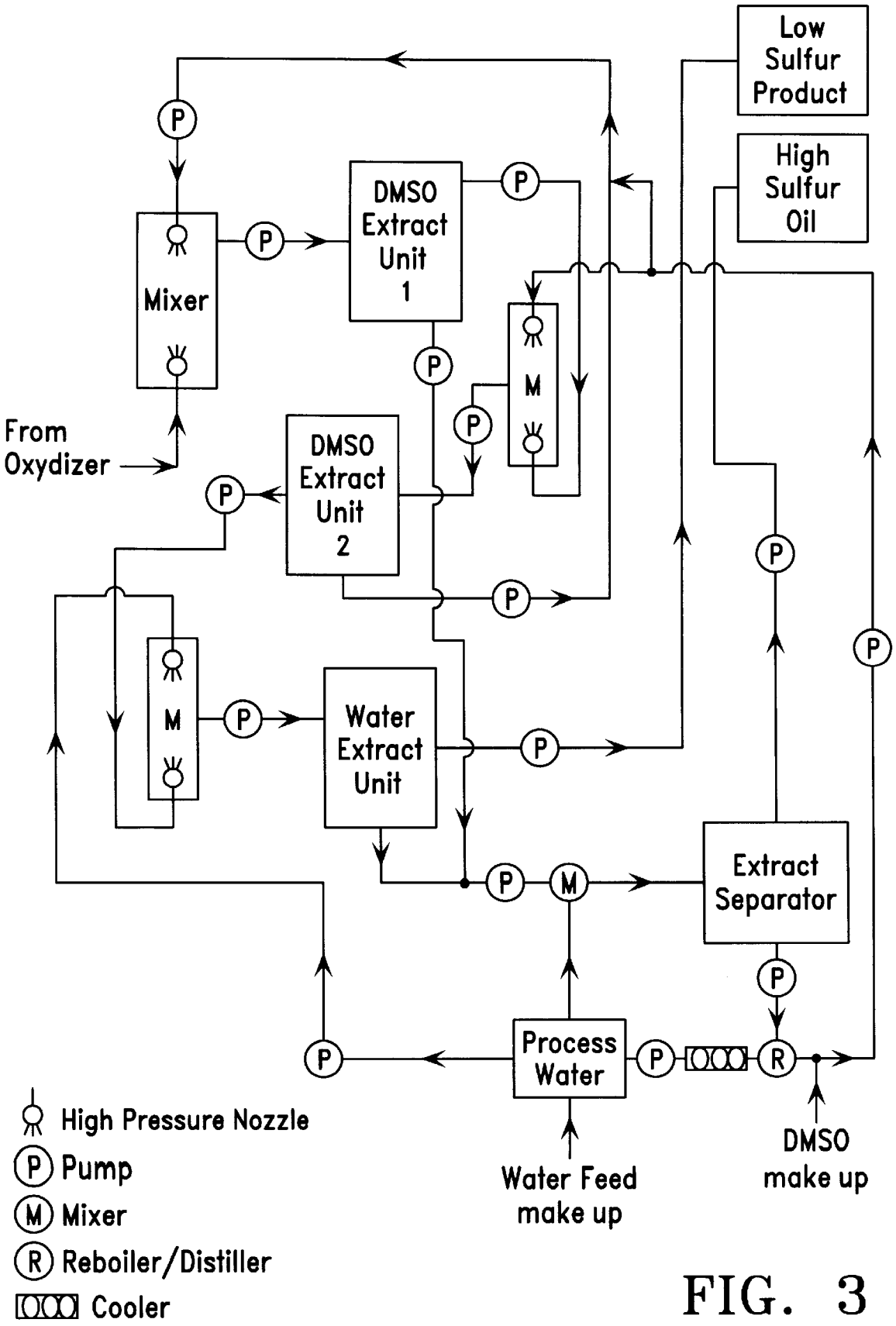
FIG. 3 is a schematic diagram of the solvent extraction process.

FIG. 3 shows the extraction process. Here, the oxidized product is pumped into a unit where it is mixed with an extraction solvent (DMSO is the preferred solvent) and then it is pumped into a mixing unit. The residence time in this mixing unit is rather short compared to the time for oxidation. The temperature and pressure of the extraction system are varied using Raoult's and Henry's laws to provide maximum extraction of the oxidized species with little or no removal of the other less polar species. This process may be repeated several times using additional units to increase the efficiency of the stripping process.

Residual DMSO in the product stream may be removed using process water. An additional stripping unit of the same configuration as the DMSO stripper unit described above may be used for this purpose. Upon separation, the water is pumped to the DMSO extraction separator where it is mixed with additional process water for addition the DMSO extract separator as described below.

Following separation, the treated product in pumped through a clay filter for final polishing and storage as a low sulfur (<0.05 wt %) product. The DMSO mixture is removed to a system that separates the DMSO from the oxidized sulfur-containing compounds.

As the DMSO/oxidized sulfur compound stream is introduced to the extract separator process, water is added to force the high sulfur oil out of solution. The use of approximately 1 to 2 volumes of water per volume of DMSO mixture results in the formation of an oil containing virtually all the oxidized constituents. The high sulfur stream that contains up to 15% by weight of sulfur is then pumped off for further treatment. The resulting DMSO/water mixture is sent to distillation for concentration of DMSO. The separated DMSO and water from the distillation process, are recycled and reused continually in a closed loop.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A method for removing sulfur- and nitrogen-containing compounds from a liquid fuel that includes, hydrocarbon fuel compounds, comprising the steps of:

a) oxidizing a liquid fuel with an oxidant to form oxidized sulfur- and nitrogen-containing compounds;

b) monitoring the oxidizing of said liquid fuel;

c) stopping said oxidizing when greater than about 90 percent of the sulfur- and nitrogen-containing compounds have been oxidized, but before any of the hydrocarbon fuel compounds have been oxidized;

d) separating the liquid fuel containing oxidized sulfur- and nitrogen-containing compounds from depleted oxidant; and e) extracting said oxidized sulfur- and nitrogen-containing compounds from the liquid fuel by contacting said liquid fuel with a solvent that is selective for the oxidized sulfur- and nitrogen-containing compounds.

2. The method of claim 1 further comprising the step of separating the oxidized sulfur- and nitrogen-containing compounds from said solvent by gravity separation.

3. The method of claim 1 further comprising the step of separating the oxidized sulfur- and nitrogen-containing compounds from said solvent by gravity separation.

4. The method of claim 1 further comprising the step of:

a) washing the oxidized sulfur- and nitrogen-containing compounds with water; and b) polishing the oxidized sulfur- and nitrogen-containing compounds using clay filtration.

5. The method of claim 1 wherein the oxidant is selected from the group of perboric acid, persulfuric acid, peracetic acid, direct ozone and dioxirane.

6. The method of claim 1 wherein the solvent is selected from the group of dimethyl sulfoxide, methanol, sulfolane, triethanolamine, and acetonitrile.

7. The method of claim 1 wherein the oxidizing step is confirmed by use of gas chromatography.

8. The method of claim 1 wherein the oxidizing step is confirmed by use of an infrared spectrometer.

9. The process of claim 1 wherein the oxidizing is stopped when oxidation of the sulfur-containing compounds has reached between about 95 to 98 percent.

10. The process of claim 1 wherein the step of stopping of the oxidizing includes the step of cooling the reaction to a point between about 20 to 30 degrees C. lower than the reaction temperature.

11. The process of claim 10 wherein the step of stopping of the oxidizing further includes the step of adding a reducing agent during the step of cooling the reaction.

12. The process of claim 11 wherein the reducing agent is selected from the group of sodium thiosulfate and sodium bisulfite.

13. The process of claim 11 wherein the reducing agent is injected into the reaction in a dilute aqueous solutions containing between about 1 to 5 weight percent of the reducing agent.

14. The process of claim 1 wherein the temperature of the oxidizing step is between about 30 to 110 degrees Celsius.

15. The process of claim 1 wherein the temperature of the oxidizing step is between about 60 and 95 degrees Celsius.

16. The process of claim 1 wherein the oxidizing step pressure is less than 150 pounds per square inch gauge.

17. A method for removing sulfur- and nitrogen-containing compounds from a liquid fuel, comprising:

(a) treating a liquid fuel that includes, hydrocarbon fuel compounds, and sulfur- and nitrogen-containing compounds with an oxidant to provide a liquid fuel that includes oxidized sulfur- and nitrogen-containing compound and depleted oxidant, wherein the oxidant converts greater than about 90 percent of the sulfur- and nitrogen-containing compounds, to oxidized sulfur- and nitrogen-containing compounds, but wherein said treatment is stopped before any of the hydrocarbon fuel compounds have been oxidized;

(b) monitoring the conversion of the sulfur- and nitrogen-containing compounds to oxidized sulfur- and nitrogen-containing compounds; and (c) extracting the oxidized sulfur- and nitrogen-containing compounds from the liquid fuel by contacting the liquid fuel that includes the oxidized sulfur- and nitrogen-containing compounds with a solvent selective for the sulfur- and nitrogen-containing compounds.

18. The method of claim 17, further comprising separating the liquid fuel that includes oxidized sulfur- and nitrogen-containing compounds from the depleted oxidant, prior to extracting said oxidized sulfur- and nitrogen-containing compounds from said liquid fuel.

19. The method of claim 17, wherein the oxidant comprises peroxyacetic acid.

20. The method of claim 17, wherein the solvent comprises dimethylsulfoxide.

21. The method of claim 17, wherein the oxidant converts greater than about 95 percent of the sulfur- and nitrogen-containing compounds to oxidized sulfur- and nitrogen-containing compounds.

22. The method of claim 17, wherein the oxidant converts greater than about 98 percent of the sulfur- and nitrogen-containing compounds to oxidized sulfur-containing and nitrogen-containing compounds.

* * * * *